US008197300B2

(12) United States Patent
Junge et al.

(10) Patent No.: US 8,197,300 B2
(45) Date of Patent: Jun. 12, 2012

(54) SIMULTANEOUS DOUBLE-SIDE GRINDING OF SEMICONDUCTOR WAFERS

(75) Inventors: Joachim Junge, Burghausen (DE); Robert Weiss, Winhoering (DE)

(73) Assignee: Siltronic AG, Munich (DE)

( * ) Notice: Subject to any disclaimer, the term of this patent is extended or adjusted under 35 U.S.C. 154(b) by 913 days.

(21) Appl. No.: 12/242,959

(22) Filed: Oct. 1, 2008

(65) Prior Publication Data

US 2009/0104846 A1 Apr. 23, 2009

(30) Foreign Application Priority Data

Oct. 17, 2007 (DE) ..... 10 2007 049 810

(51) Int. Cl.
*B24B 49/00* (2006.01)

(52) U.S. Cl. ..... 451/8; 451/9; 451/41; 451/63; 451/268; 73/862.321

(58) Field of Classification Search ..... 451/5, 8, 451/9, 10, 11, 28, 41, 63, 261, 262, 268, 451/285, 287, 290; 73/862.321
See application file for complete search history.

(56) References Cited

U.S. PATENT DOCUMENTS

| | | | | |
|---|---|---|---|---|
| 4,432,245 | A * | 2/1984 | Hattori et al. | 73/862.321 |
| 6,652,358 | B1 | 11/2003 | Ikeda et al. | |
| 2005/0202757 | A1 | 9/2005 | Junge et al. | |

FOREIGN PATENT DOCUMENTS

| | | | |
|---|---|---|---|
| DE | 10 2004 011 996 | A | 9/2005 |
| DE | 10 2004 053 308 | A | 3/2006 |
| EP | 0868974 | A2 | 10/1998 |
| EP | 1616662 | A1 | 1/2006 |
| JP | 11254312 | A | 9/1999 |
| JP | 2001062718 | A | 3/2001 |
| JP | 2002292558 | A | 10/2002 |
| JP | 2005201862 | A | 7/2005 |
| WO | 00/67950 | A1 | 11/2000 |

* cited by examiner

*Primary Examiner* — Eileen P. Morgan
(74) *Attorney, Agent, or Firm* — Brooks Kushman P.C.

(57) ABSTRACT

Correction of grinding spindle positions in double-side grinding machines for the simultaneous double-side machining of semiconductor wafers is achieved by torsionally coupling the two grinding spindles, each comprising a grinding disk flange for receiving a grinding disk, and providing a measuring unit with an inclinometer and two sensors for distance measurement, between the two grinding disk flanges such that the grinding spindles are essentially in the position they would have with mounted grinding disks during the grinding process, wherein the coupled grinding spindles are rotated while inclinometer and sensors determine radial and axial correction values of axial alignment to adjust the grinding spindles to a symmetrical orientation. The spindle positions may be corrected under the action of process forces.

13 Claims, 2 Drawing Sheets

SIMULTANEOUS DOUBLE-SIDE GRINDING OF SEMICONDUCTOR WAFERS

BACKGROUND OF THE INVENTION

1. Field of the Invention

The invention relates to a method for the double-side grinding of semiconductor wafers, in particular, to a method for the alignment of double-side grinding machines through improved orientation of the grinding spindles of double-side grinding machines, correction of the grinding spindle positions, and suitable devices for carrying out the method.

2. Background Art

Double-side grinding machines are used in mechanical machining steps in fabrication sequences of the wafer industry for producing semiconductor wafers, in particular silicon wafers. A mechanically abrasive, material-removing machining of the semiconductor wafers is involved.

Simultaneous double-side grinding ("double disk grinding", DDG) is often used in order to achieve a particularly good geometry of the machined semiconductor wafers, in particular in comparison with alternative machining methods such as so-called lapping methods. A suitable DDG method and devices suitable for carrying out the method are known, for example from EP 868 974 A2.

The semiconductor wafer is machined simultaneously on both sides in free-floating fashion between two grinding wheels or disks mounted on opposite spindles. In this case, the semiconductor wafer is guided in a manner substantially free of constraint forces axially between two water or air pads (e.g. the so-called hydropads) and prevented from "floating away" radially by a guide ring or by individual radial spokes. During the grinding process, the semiconductor wafer is rotated, usually in a manner driven by a so-called "notch finger" that engages into the orientation notch of the semiconductor wafer.

Suitable DDG machines are offered for example by Koyo Machine Industries Co., Ltd. The model DXSG320 is suitable for grinding semiconductor wafers having a diameter of 300 mm. Diamond grinding disks are usually used as grinding tools.

What is particularly critical in the DDG method is the orientation of the two grinding spindles (=shafts) on which the grinding disks are mounted. The two spindles should be oriented exactly collinearly in the course of the basic setting of the machine since deviations (radially, axially) adversely influence the shape and nanotopology of the wafer. As far as the shape of the wafer is concerned, terms employed by the person skilled in the art to characterize the shape include bow and warp.

Proceeding from this (often asymmetrical) basic setting, the spindles are subsequently tilted symmetrically in order to satisfy corresponding product criteria, inter alia with regard to the grinding pattern (cross-grinding) or the global geometry GBIR (formerly: TTV, "total thickness variation"). JP 2001-062718 discloses a corresponding method. With an already equipped machine in the working position, the offset of the wafer perpendicular to the spindle direction (radially) is measured by means of eddy current sensors and the position of the grinding spindles is set accordingly. The grinding spindles are thus moved with the grinding disks fixed on them in the working position and tilted essentially symmetrically with respect to the basic setting (tilt or grinding tilt).

In the context of this invention, the asymmetrical deviations of the axial alignment are also referred to as parallelism deviation or angular deviation. The terms machine axial alignment or simply axial alignment are also familiar to the person skilled in the art in this connection. Parallelism deviation is intended to denote the distance between the center lines of the two grinding spindles at a specific point, and angular deviation the angle between these two center lines.

In the prior art efforts have already been made to solve the problems outlined since—as mentioned above—grinding spindles that are not oriented exactly in the basic setting have a considerable influence on the grinding result.

EP 1 616 662 A1 describes a method which provides for determining, in the working position, in each case the distances between the hydropads and three predetermined positions on the front and rear sides of the workpiece by means of displacement sensors, for calculating therefrom deformations of the workpiece with respect to the at least three positions, and for correspondingly orienting the axial positions of the grinding disks in the event of excessively large deviations.

DE 10 2004 011 996 A1 likewise discloses integrating into hydropads one or a plurality of measuring sensors which, during the grinding process, make it possible to measure the distance between the surface of the hydropads and the workpiece surface. These distance measurements serve for centering the workpiece between the hydropads by means of axial displacement of the grinding spindles in such a way that the distance between the workpiece and the hydropad becomes identical on both sides of the workpiece. A similar method, which refers in particular to a center plane of the workpiece and provides three distance sensors in the wafer guide, is also known from DE 10 2004 053 308 A1.

What is disadvantageous about the known methods is that the parallelism deviation of the grinding spindles (distance between the center lines of the spindles) is left out of consideration for lack of radial measured values. The basic setting of the grinding spindles cannot be corrected by the methods described. This also applies to the method disclosed in JP 2001-062718.

For carrying out the distance measurement itself, mechanical probes, as disclosed e.g. in JP 2005-201862, and eddy current sensors are known. Furthermore, optical measuring units, e.g. by means of a laser, are already prior art. Measuring units of this type are available e.g. from db Prüftechnik (OPTALIGN® models). Commercially available inclinometers (electrical spirit levels) are suitable for the angle measurement.

SUMMARY OF THE INVENTION

An object of the invention was to modify the prior art in such a way so as to enable an exact axial alignment measurement in the grinding position on DDG grinding machines. This and other objects are achieved by means of a method for the correction of the grinding spindle positions in double-side grinding machines for the simultaneous double-side machining of semiconductor wafers, wherein the two grinding spindles, each comprising a grinding disk flange for receiving a grinding disk, are coupled torsionally by means of a coupling element, and a measuring unit comprising an inclinometer and two sensors for distance measurement is mounted instead of grinding disks between the two grinding disk flanges in such a way that the grinding spindles are in this case essentially in the position in which they are situated with mounted grinding disks during the grinding process, wherein the coupled grinding spindles are rotated while inclinometer and sensors are used to determine radial and axial correction values of an axial alignment of the two grinding spindles which are used for a symmetrical orientation of the two grinding spindles.

DETAILED DESCRIPTION OF THE PREFERRED EMBODIMENT(S)

Figure 1:
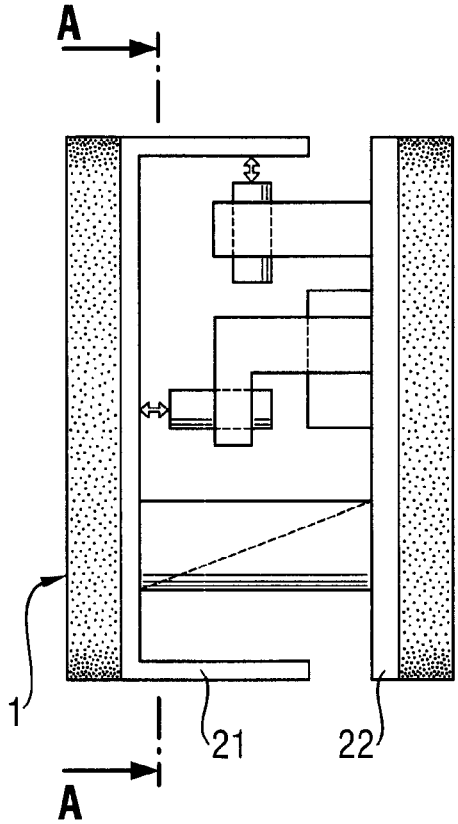
FIGS. 1 and 1*a* illustrate embodiments of the axial alignment measurement in the working position.
Figure 1A:
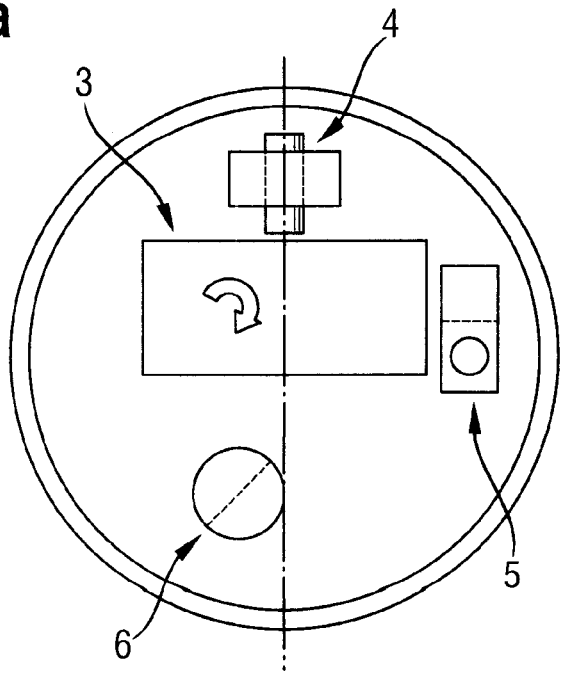

With reference to FIGS. 1 and 1*a*, a measuring unit is mounted instead of the grinding disks between the grinding disk flanges 1. The two spindles are torsionally coupled to one another by the coupling element 6. The spindle advance shafts or the grinding disk flanges 1 are moved precisely to the working position (later grinding position). The measuring unit itself comprises a sensor 5 for distance measurements in the axial direction (parallel to the spindle axis) and a sensor 4 for distance measurements in the radial direction. Furthermore, the construction comprises an inclinometer 3 for measuring 3, 6, 9 and 12 o'clock angular position.

Inclinometer 3 and sensors 4 and 5, and one half of coupling element 6 are fixed to the right-hand receptacle plate 22. The other half of the coupling element is fixed to the left-hand receptacle plate 21. Furthermore, the left-hand receptacle plate 21 serves as a "measuring bell". The distance is measured relative to the bell by the sensors. The entire system is referred to as a measuring unit.

Figure 2:
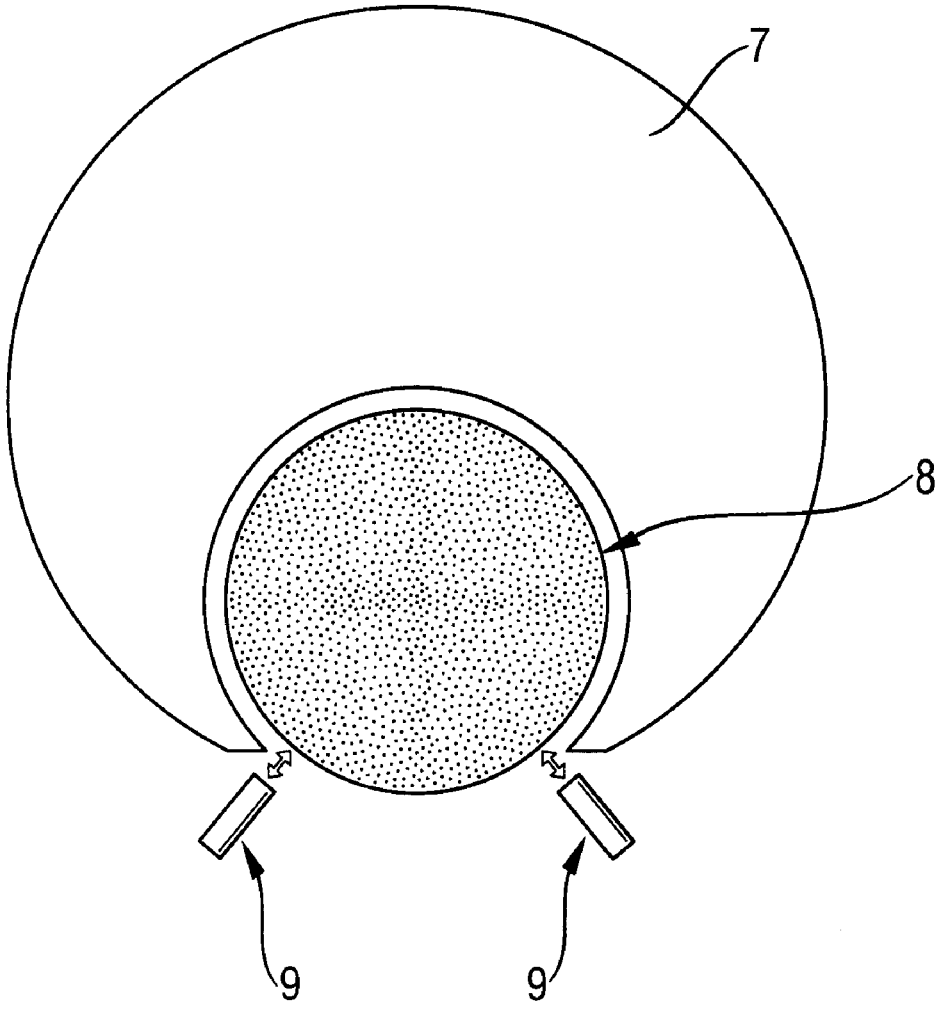
FIG. 2 schematically shows a measurement arrangement with process forces acting for a grinding spindle.

FIG. 2 illustrates the measurement construction for the measurement of the radial offset with process forces acting for a spindle: a wafer guide 7 (e.g. hydropad & guide ring), a grinding disk 8 and two sensors 9. The sensors 9 are fixed to the hydropad, illustrated here as wafer guide 7, and are spaced apart by a specific angle with respect to a circumference of the grinding disk 8.

Preferably, the inclinometer is used to measure an angle of rotation, the first sensor is used to measure a radial distance from an opposite grinding disk flange and the second sensor is used to measure an axial distance from a measuring bell on the diameter described by this sensor during the rotation.

A type of measuring bell is required as a reference system for the measurement of the axial distance. A suitable device in the form of a receptacle plate fixed on a grinding disk flange and having a strip arranged vertically relative to the flange (parallel to the spindle axis) is illustrated in FIG. 1. Axial measurement is effected with respect to said strip. A multiplicity of other configurations are likewise conceivable. Since fixed mounting on the flange is effected, the measuring bell is also rotated during the measurement.

Preferably, horizontal and vertical correction values of the axial alignment of the two grinding spindles are determined from angle of rotation and radial and axial distances taking account of machine-typical lever travels.

Preferably, the sensors are optical or inductive distance meters and preferably, eddy current sensors having a resolution of 0.4 μm-2 μm are involved. Preferably, a control unit is used for conditioning the measurement data of angle of rotation and distances and also for calculating the horizontal and vertical corrections. The torsionally coupled grinding spindles are preferably rotated through 360° during the measurements.

Suitable for carrying out this method is a device comprising two opposite, collinear rotatable grinding spindles each comprising a grinding disk flange, suitable for receiving a grinding disk, wherein, between the two torsionally coupled grinding disk flanges, a measuring unit, comprising an inclinometer and two sensors for distance measurement, is mounted on one of the two grinding disk flanges, wherein the grinding spindles are in this case essentially in a position in which they are situated with mounted grinding disks during a grinding process, and wherein a first sensor is suitable for measuring a radial distance from a grinding disk flange opposite the sensor and a second sensor is suitable for measuring an axial distance from a measuring bell mounted on the grinding disk flange.

The axial distance is preferably determined with reference to a measuring bell that is fixed on this grinding disk flange and is arranged in the spindle direction. The measuring bell preferably comprises at least one strip as a reference for axial distance measurements which is arranged parallel to the spindle axis and is mounted on the grinding disk flange.

The axial alignment measurement is carried out in the working position of the spindle guides, that is to say essentially in the position in which the semiconductor wafer is ground. This is achieved, inter alia, by means of a particularly compact construction of the sensors and inclinometer used for measurement, and constitutes a major advantage of the invention.

The eddy current sensors preferably used enable a relatively compact construction of the measuring unit which is desirable for carrying out the method. Both sensors and inclinometer are preferably mounted by means of a suitable mount instead of the grinding disks on a grinding disk flange. Preferably, a construction of the measuring device comprising sensors and inclinometer also comprises mounts that are fixed to the grinding disk flange by means of screws. A control unit positioned outside the machine is preferably used for the data conditioning and for the calculation of the correction values. The entire construction of the measuring device after mounting on the grinding disk flanges is preferably less than 50 mm wide.

Since the measurement construction is mounted instead of the grinding disks, the grinding disk flanges preferably lie apart from one another by approximately 50 mm or less. This corresponds approximately to the working position in which the basic setting is performed.

The entire construction is preferably rotated through 360° while the axial and radial measured values are recorded by sensors and measuring unit or control unit. For this purpose, first of all the two grinding spindles are torsionally coupled. The rotation of the coupled spindles is preferably effected manually. A measuring unit calculates the parallelism and angular deviation of the grinding spindles and therefrom the horizontal and vertical correction values taking account of machine-specific lever travels.

Correction of the spindle tilts is preferably followed by a further correction measurement with regard to axial alignment. Afterward, the grinding spindles are preferably brought to the grinding or working position (implementing the grinding tilts) and the axial alignment is measured again. If the result is not symmetrical with respect to the previous axial alignment measurement, correction is once again effected. By way of example, the measuring units and sensors of model series EX-V from Keyence are suitable for the measurements.

During the rotation, the measurement data acquisition of the axial and radial deviations is effected e.g. at four angular positions 3 o'clock, 6 o'clock, 9 o'clock and 12 o'clock. The angular positions preferably have a respective spacing of 90°. The respective angle of rotation is preferably determined by means of an inclinometer integrated in the measurement construction.

From these measured values, the axial offset can be described by the following formulae:

$$VP=(R6-R0)/2;\ HP=(R9-R3)/2;$$

$$VW=(A6-A0)/d;\ HW=(A9-A3)/d;$$

where VP=parallelism deviation vertical, HP=parallelism deviation horizontal, VW=angular deviation vertical and HW=angular deviation horizontal.

R0 corresponds e.g. to the radial (=R) measured value at 0 hours (=12 o'clock), A3 corresponds e.g. to the axial (=A) measured value at 3 o'clock, etc. d denotes the diameter of the circle described by the sensor that effects measurement in the axial direction.

These values result, in a manner dependent on the machine type, in axial and radial correction values over the corresponding lever travels. VP and VW are used for calculating the vertical correction values of the two spindles. A vertical correction value that takes account both of angular deviation VW and of parallelism deviation VP under the influence of the lever travels results separately for each spindle.

HP and HW are used for calculating the horizontal correction values. The result is 2 correction values (horizontal and vertical) for each spindle. These values may perfectly well turn out to be different for the two spindles.

The corrections are preferably calculated automatically. Preferably, a control unit indicates 4 values (VP, HP, VW, HW). The measured values of the 2 sensors are preferably conditioned by means of an amplifier in the measuring unit (control unit) and subsequently converted into the necessary tilt information by means of an integrated or separate computer.

The various parameters such as tilting lever of the machine, measurement circle diameter d, etc. are taken into account in this case. The corrections are therefore dependent on the machine type used and on the construction of the measuring device or the arrangement of the sensors. In particular, distances between articulated joint and tilting drive or measurement position are incorporated in the calculation. Four correction values LV, RV, LH, RH (L=left, R=right, H=horizontal, V=vertical) are finally produced in this case.

The inclinometer is an electronic spirit level. The ISU Inclinometer Board from Althen Mess- und Sensortechnik, for example, is suitable for this. The inclinometer is preferably mechanically connected to the two sensors via the receptacle device. After the spindle inclination correction by means of the correction values, the two spindles should be aligned with one another and thus produce a reference setting from which the spindles are subsequently adjusted symmetrically (grinding tilt) and optimum grinding tilts are thus implemented.

The grinding tilts are preferably implemented automatically by virtue of the calculated tilts being input into a control program of the DDG machine and being implemented automatically by the machine. In the case of the DDG machines from Koyo this corresponds, for example, to the "tilt move" program. Manual tilt correction by means of screws (socket head screws) is possible when other machine types are used.

After axial alignment setting has been carried out, the grinding spindles preferably with mounted measuring device are moved to the grinding tilts. A renewed axial alignment measurement shows whether the tilting was actually effected symmetrically. If this was not the case owing to non-identical behavior of the tilt adjusting mechanisms or different bearing play within the machine, correction is preferably once again effected, with the result that an optimum symmetry of the spindle orientation is finally ensured.

A further aspect of the invention provides for determining radial measured values and thus the radial offset of the grinding spindle positions also under the action of process forces.

Suitable for this is a method for the simultaneous double-side grinding of a semiconductor wafer, wherein a semiconductor wafer is machined in material-removing fashion between two rotating grinding wheels affixed on opposite collinear spindles, wherein the semiconductor wafer, during machining, is guided axially by means of two hydrostatic bearings in a manner substantially free of constraint forces and radially by means of a guide ring and is caused to effect rotation by a driver, wherein during the grinding of a semiconductor wafer, by means of at least two sensors, radial distances between at least one hydrostatic bearing and a grinding wheel are measured and horizontal and vertical correction values of the spindle position are calculated therefrom, and the spindle position is correspondingly corrected.

Preferably, the two sensors are mounted on the hydrostatic bearing, wherein they are spaced apart by an angle of at least 30° and at most 150° (ideally: 90°) with respect to a circumference of the grinding disk cf. FIG. 2.

Preferably, firstly a semiconductor wafer is machined in this way for test purposes and the horizontal and vertical deviations are determined for this spindle. Preferably, this process is subsequently repeated analogously for the opposite spindle and the horizontal and vertical deviations are likewise determined.

By means of the 4 deviations thus obtained (horizontal, vertical, respectively left and right), the spindle tilts are preferably corrected again (asymmetrically), thus resulting in a symmetrical deviation from the static axial alignment measurement.

Preferably, the sensors are demounted in the grinding processes that succeed machining of a test wafer. The sensors are preferably eddy current sensors. This measurement is therefore effected during the grinding process. The process forces and their effects on the spindle positions are thus implicitly taken into account in the corrections.

The sensors are in each case mounted on one of the two hydrostatic bearings and measure a distance radially from the grinding wheel. By means of the two sensors, the radial offset of the grinding wheels or spindles is determined during the grinding process. This is preferably done separately for the two spindles. The fact that this measurement is preferably carried out separately for the left-hand spindle and the right-hand spindle may be advantageous since the sensors could mutually influence one another in the case of simultaneous measurement.

After correction of the positions of the left-hand and right-hand grinding spindles, the overall result is a correction of the parallelism deviations of the two spindles, although in this case taking account of process forces, which constitutes a particular advantage of this aspect of the invention.

On account of the spacing apart of the two sensors arranged radially around the grinding disk, the magnitude and direction of the radial offset can be determined unambiguously. Axial measured values are not determined.

The radial measured values are used taking account of the machine-specific lever travels as an offset for the grinding tilts (spindle inclination values). It is thus possible to determine the radial offset both in terms of direction and in terms of magnitude between spindle idling and load operation for the two spindles separately.

The measured radial values are decomposed into the horizontal and vertical components with a given fixed angular position. The respective difference (left-right value) is used half each as correction value for left-hand and right-hand spindle. These values are incorporated as an offset with different signs into the left and right spindle tilts. The spindles are therefore preset asymmetrically in such a way that they are axially aligned symmetrically again under load. The use of an inclinometer is not necessary, nor is it preferred, since the measurement angle is predetermined by arrangement of the sensors. A horizontal and a vertical correction value thus result once again per spindle.

The correction thus determined preferably serves as an offset for an axial alignment measurement previously carried out statically and enables an extremely symmetrical grinding tilt setting. Therefore, it is particularly preferred for the static axial alignment measurement disclosed previously to be combined with the correction of the radial offset as described here.

Preferably, the measurements during grinding are not only carried out on a test wafer, but are used in the course of production. The two spindles are measured simultaneously in this case. For this purpose, the two hydrostatic bearings are equipped with sensors. The corrections of the tilt offsets are effected automatically by means of the machine control.

The automatic spindle setting is effected by virtue of the corrections determined being stored in the grinding prescription ("tilt move") and being implemented by the machine.

For the case where the measurement is effected only once during the grinding of a test wafer, by contrast, the offset thus determined is regarded as constant and taken into account in each case in subsequent grinding steps by virtue of the grinding tilts that are subsequently to be used being correspondingly shifted by this offset. During subsequent production, the sensors are preferably demounted in this case.

The invention also relates to a device comprising a hydrostatic bearing (7) for axially guiding a semiconductor wafer in a double-side grinding machine, said bearing comprising a cutout through which a grinding disk (8) interacts with a semiconductor wafer, wherein two sensors (9) for distance measurement are mounted on the hydrostatic bearing, which sensors (9) are spaced apart by an angle of at least 30° and at most 150° with respect to a circumference of the grinding disk (8). The hydrostatic bearing is preferably a hydropad according to the prior art. The sensors are used for the measurement of radial distances between hydrostatic bearing and a grinding wheel of a double-side machine and for the correction of a grinding spindle position.

An advantage of the methods according to the invention is a significantly more symmetrical grinding spindle orientation by virtue of exact axial alignment measurement, taking process forces into account. The DDG machines aligned in this way make it possible to produce ground semiconductor wafers with improved shape, bow, warp and nanotopographies.

Weak points in the guides of the machine with inaccurate orientation of the spindles and also increased undesirable bearing play are substantially avoided by the method according to the invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for the correction of grinding spindle orientation in a double-side grinding machine for the simultaneous double-side machining of semiconductor wafers, the grinding machine having two coaxial grinding spindles, each spindle comprising a grinding disk flange for attaching a grinding disk, the method comprising:

torsionally coupling the two grinding spindles by a torsional coupling element;

providing a measuring unit comprising an inclinometer and at least two sensors for distance measurement;

mounting the measurement unit between the grinding disk flanges, the grinding disk flanges having no grinding disks attached thereon, such that the grinding spindles are in the same position they would occupy during a later double-side machining of a semiconductor wafer;

rotating the torsionally coupled grinding spindles and determining radial and axial correction values for an axial alignment of the two grinding spindles by means of the inclinometer and the sensors, and using these values to correct an orientation of the two grinding spindles to obtain a symmetrical orientation of the two grinding spindles.

2. The method of claim 1, wherein the inclinometer measures an angle of rotation, a first sensor measures a radial distance from an opposite grinding disk flange and a second sensor measures an axial distance on a diameter described by this sensor during rotation of the grinding spindles, wherein a receptacle plate fixed on the grinding disk flange serves as a measuring bell for the radial and axial distance measurements.

3. The method of claim 2, wherein horizontal and vertical correction values of the axial alignment of the two grinding spindles are determined from angle of rotation and radial and axial distances with respect to machine-typical lever travels.

4. The method of claim 1, wherein the sensors are optical or inductive distance sensors.

5. The method of claim 4, wherein the inductive distance sensor is an eddy current sensor having a resolution of 0.4 μm-2 μm.

6. The method of claim 1, wherein a control unit conditions angle of rotation and distance data and calculates horizontal and vertical corrections for spindle adjustment.

7. The method of claim 1, wherein the torsionally coupled grinding spindles are rotated through 360° during a measurement cycle of the inclinometer, sensors, or both inclinometer and sensors.

8. A method for the simultaneous double-side grinding of a semiconductor wafer employing the correction method of claim 1, further comprising machining a semiconductor wafer in material-removing fashion between two rotating grinding disks affixed on opposite collinear spindles, wherein the semiconductor wafer, during machining, is guided axially by means of two hydrostatic bearings in a manner substantially free of constraint forces, is guided radially by means of a guide ring, and is caused to rotate by a driver, wherein during the grinding of a semiconductor wafer, radial distances between at least one hydrostatic bearing and a grinding wheel are measured by means of at least two sensors, and horizontal and vertical correction values of a position of a spindle are calculated therefrom, and the spindle position is correspondingly corrected.

9. The method of claim 8, wherein two sensors are fixed to a hydrostatic bearing, the sensors spaced apart by an angle of at least 30° and at most 150° with respect to a circumference of an associated grinding disk.

10. The method of claim 8, wherein two sensors are fixed to each of the two hydrostatic bearings, the sensors on each bearing spaced apart by an angle of at least 30° and at most 150° with respect to a circumference of the associated grinding disk.

11. The method of claim 8, wherein the sensors are eddy current sensors.

12. A device for carrying out the method of claim 1, comprising two opposite, collinear rotatable grinding spindles each comprising a grinding disk flange suitable for receiving a grinding disk, wherein the grinding disk flanges are torsionally coupled, and between the two torsionally coupled grinding disk flanges, at least one measuring unit comprising an inclinometer and at least two sensors for distance measurement is mounted on one of the two grinding disk flanges, wherein the grinding spindles are in a position in which they would be situated with mounted grinding disks during a grinding process, and wherein a first sensor is suitable for measuring a radial distance from a grinding disk flange opposite the sensor and a second sensor is suitable for measuring an axial distance from a measuring bell mounted on the grinding disk flange.

13. The device of claim 12, wherein the measuring bell is a receptacle plate which comprises horizontal and vertical strips in the direction of the spindle axis and is mounted on a grinding disk flange, wherein one sensor is directed at the horizontal strip (radial distance sensor) and the second sensor is directed at the vertical strip (axial distance sensor).

* * * * *